US009644915B2

(12) United States Patent
Alderman

(10) Patent No.: US 9,644,915 B2
(45) Date of Patent: May 9, 2017

(54) TRIGGER ASSIST MODULE FOR A NON-FULLY AUTOMATIC FIREARM

(71) Applicant: Robert Joe Alderman, Poteet, TX (US)

(72) Inventor: Robert Joe Alderman, Poteet, TX (US)

( * ) Notice: Subject to any disclaimer, the term of this patent is extended or adjusted under 35 U.S.C. 154(b) by 0 days.

(21) Appl. No.: 14/658,384

(22) Filed: Mar. 16, 2015

(65) Prior Publication Data

US 2015/0267992 A1 Sep. 24, 2015

Related U.S. Application Data

(60) Provisional application No. 61/967,364, filed on Mar. 18, 2014.

(51) Int. Cl.
*F41A 19/59* (2006.01)
*F41A 19/09* (2006.01)

(52) U.S. Cl.
CPC ..... *F41A 19/59* (2013.01); *F41A 19/09* (2013.01)

(58) Field of Classification Search
CPC ..... F41A 19/59; F41A 19/58; F41A 19/09; F41A 19/08
USPC ..... 42/90, 69.01, 84, 1.02, 1.03, 1.04
See application file for complete search history.

(56) References Cited

U.S. PATENT DOCUMENTS 3,828,458 A * 8/1974 Skone-Palmer ..... F41A 19/56 42/106
4,718,187 A * 1/1988 Blake ..... F41A 19/59 42/84
5,005,307 A * 4/1991 Horne ..... F41A 9/62 42/1.02
5,034,686 A * 7/1991 Aspelin ..... F41G 7/006 102/206
5,727,538 A * 3/1998 Ellis ..... F41B 11/57 124/32
6,142,137 A * 11/2000 MacLaughlin ..... F41A 19/64 124/32
6,286,242 B1 * 9/2001 Klebes ..... F41A 19/58 42/70.01
6,615,814 B1 * 9/2003 Rice ..... F41A 17/06 124/71
6,715,395 B1 * 4/2004 Heibel ..... F41A 19/58 180/287
8,036,704 B2 * 10/2011 Werner ..... F41A 19/08 124/31
2008/0115660 A1 * 5/2008 Hensel ..... F41A 19/69 89/136
2008/0121097 A1 * 5/2008 Rudakevych ..... F41A 19/58 89/28.05

(Continued)

*Primary Examiner* — Joshua Freeman
(74) *Attorney, Agent, or Firm* — Law Office of William F. Ryann

(57) ABSTRACT

A module to provide assistance in pulling of a trigger of a non-fully automatic firearm. The module includes a finger extension which engages the trigger and is powered by a compact motor such as an electrically driven solenoid. Further, the rate of trigger pulls and other parameters thereof are determined according to a processor of the module that is programmed to direct the solenoid. Thus, a user of the firearm may remain focused on sights and targeting while the act of achieving a trigger pull is accomplished by the extension of the module. Therefore, accuracy and safety of may be enhanced for the firearm.

17 Claims, 5 Drawing Sheets

(56) References Cited

U.S. PATENT DOCUMENTS

| | | | | |
|---|---|---|---|---|
| 2009/0158922 | A1* | 6/2009 | Werner | F41A 19/59 89/136 |
| 2012/0240442 | A1 | 9/2012 | Cottle | |
| 2013/0145670 | A1* | 6/2013 | Kuhlman | F41A 19/59 42/84 |
| 2014/0311003 | A1 | 10/2014 | Loreman | |
| 2014/0378088 | A1* | 12/2014 | Goel | F41A 17/063 455/404.2 |

* cited by examiner

TRIGGER ASSIST MODULE FOR A NON-FULLY AUTOMATIC FIREARM

PRIORITY CLAIM/CROSS REFERENCE TO RELATED APPLICATION(S)

This Patent Document claims priority under 35 U.S.C. §119 to U.S. Provisional App. Ser. No. 61/967,364, filed Mar. 18, 2014, and entitled, "Trigger Pull Assist", which is incorporated herein by reference in its entirety.

BACKGROUND

Firearms, or portable guns that may be carried, generally by a single individual, have been available for several centuries. However, in the last hundred years or so, a transition has taken place from cumbersome muzzle loaded firearms to those which may generally be referred to as "self-loading". For example, the multiple chambered cylinder of a handheld revolver may be loaded with several rounds of ammunition at a single point in time. Subsequently, as the trigger of the revolver is pulled for sake of firing an initial round, the cylinder may simultaneously be rotated for "self-loading" of the next round to he fired. As a result, so long as the cylinder still contains unspent rounds, the user need not stop between firing shots in order to reload as would be the case with a muzzle loaded firearm. However, the conventional revolver does have some aspects that are less than user-friendly when the gun is put into actual use. For example, because the pull of the trigger must provide the energy sufficient for both recoiling of the hammer or firing pin and also for the rotation of the self-loading cylinder, the gun is often somewhat heavier or more difficult to control.

With the cumbersome nature of both muzzle loaded guns and revolvers in mind, more user-friendly semi-automatic firearms are often utilized, Like a revolver, a semi-automatic firearm is a self-loading firearm that is not fully automatic. That is, while self-loading, both a revolver and a semi-automatic firearm would not be considered "self-triggering" as discussed further below. The semi-automatic firearm, however, does have user-friendly advantages in that a spring loaded magazine may be utilized to provide the energy for the "self-loading" of subsequent rounds. That is, as opposed to relying on the user's band strength in pulling the trigger to rotate a cylinder for sake of loading subsequent rounds, the energy for reloading of the semi-automatic is supplied by a spring in a magazine which houses subsequent rounds. Thus, once a round is fired and space for the next round is available, the spring of the magazine will "self-load" the next round.

The semi-automatic firearm does provide some user-friendly and control advantages which in certain respects may render the firearm a bit safer. However, certain challenges remain, indeed, even in looking at the simple task of pulling a trigger, the opportunity for human error remains. For example, as a matter of physiology, users untrained in the use of firearms often display a tendency to move the gun slightly in the direction of the hand pulling the trigger as the gun is being fired. Of course, given that this is a firearm, missing a target for this reason could be of disastrous consequences. Once more, for a person that is handicapped or otherwise compromised in terms of manual abilities, the act of pulling a trigger may be impossible or of enhanced danger if attempted.

These challenges are not ones that might be addressed by way of utilizing a fully automatic firearm. That is, as alluded to above, a fully automatic firearm is one that is not only "self-loading" but is also considered to be "self-triggering". However, this term is a bit misleading in that the fully automatic firearm requires that the user pull and hold the trigger. Indeed, the only self-triggering aspect is that unlike a semi-automatic or revolver, there need not be a re-pulling of the trigger for each new round to be fired. Instead, the energy for firing of subsequent rounds is supplied by the charge of the prior fired round so long as the user maintains a manual hold on the trigger. However, this not only fails to address the need of the user to manually pull a trigger as described above but it also leads to a variety of other potential safety issues. That is, in addition to natural trigger pull control issues which a non-fully automatic might face, the automatic firearm does not require a re-pull of the trigger. Therefore, the user does not have the ability to control the rate at which the rounds are fired. As a practical matter this may mean that the user has quickly spent an uncertain amount of ammunition in a manner that has no more control in terms of accuracy than that found in the use of a non-fully automatic firearm. In fact, due to the uncontrolled rate at which rounds are fired, the hazards involved have only increased without ever addressing potential issues a user may face in terms of manual trigger pull.

SUMMARY

A trigger assist module is provided for use with a non-fully automatic firearm. The module may include a finger extension for engagement with a trigger of the firearm. Additionally, a compact electric motor may be coupled to the extension for driving it in an axial direction and in a reciprocating fashion. Thus, the trigger of the firearm may be actuated, further, a processor is coupled to the motor such that a controlled rate of firing may he directed.

BRIEF DESCRIPTION OF THE DRAWINGS

Implementations of various structure and techniques will hereafter be described with reference to the accompanying drawings. It should be understood, however, that these drawings are illustrative and not meant to limit the scope of claimed embodiments.

DETAILED DESCRIPTION

Embodiments are described with reference to a trigger assist module that is utilized with a semi-automatic firearm. Specifically, the embodiments depict a module employed with a conventional M15. However, a variety of other semi-automatic firearms may be utilized with embodiments of trigger assist modules as detailed herein, indeed, even a revolver, which would not be classified as any type of semi-automatic firearm, may be utilized with such modules. So long as the firearm is non-fully automatic, with a trigger pull required for each round fired, a controlled rate of firing may be achieved through use of the assist module and appreciable benefit may be realized. Additionally, embodiments detailed herein do not alter the underlying functionalities of non-fully automatic firearms. However, they do allow for a more controlled, and by extension: safer firing of the firearm.

Figure 1:
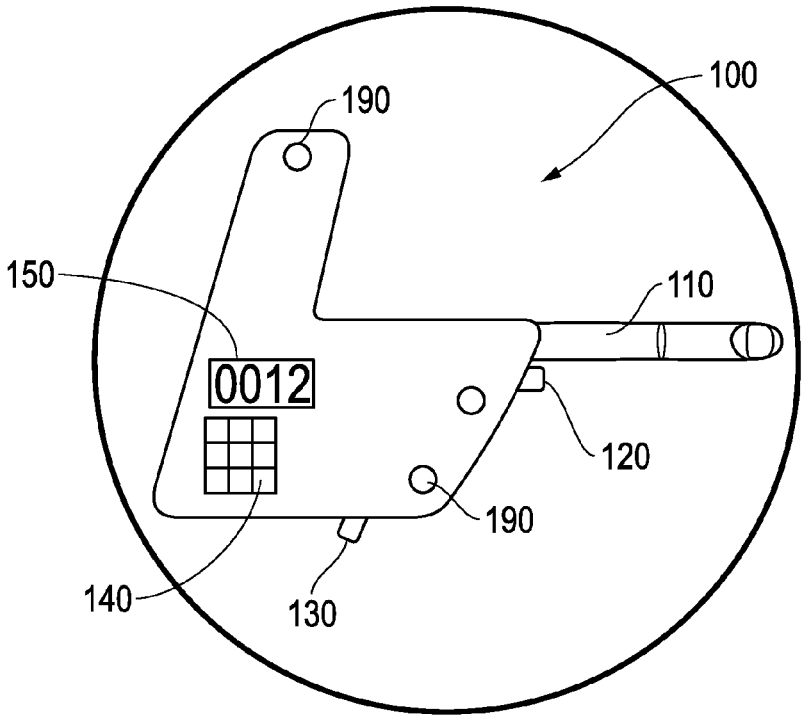
FIG. 1 is a side view of an embodiment of a trigger assist module for use with a com fully automatic firearm.

Referring now to FIG. 1, a side view of an embodiment of a trigger assist module 100 is shown. With added reference to FIG. 3, the module 100 is configured for use with a non-fully automatic firearm 300, Specifically, the module 100 houses and/or accommodates a variety of components in a package form that may be readily secured to a firearm 300 in a user friendly manner. So, for example, a component in the form of a finger extension 110 may engage a trigger 310 of the firearm 300 to provide trigger assistance for a user as detailed further below. The extension 110 may be a wire, small rod or other appropriate device of suitable size, morphology and durability for the task of trigger assistance. For sake of illustration, the extension 110 is provided with the appearance of a human finger in the Figures herein. Of course, this is only illustrative and not a required feature thereof.

In the embodiment shown, the trigger assist module 100 is also outfitted with an arming switch 130 and a manual actuator 120 in the form of a conventional press-type button. Thus, a user may turn on or "arm" the module 100 by deflecting or positioning the switch 130 to an armed position. Requiring arming in this manner may help to prevent any accidental firing by the module 100. Specifically, the arming of the module 100 may allow for the user to press the actuator 120 in order to begin reciprocation of the finger extension 110 as detailed further below. In this way, the user may be provided with controlled trigger assistance if the module 100 is secured to the firearm 300 with the extension 110 properly engaged with the trigger 310 (again see FIG. 3).

Figure 3:
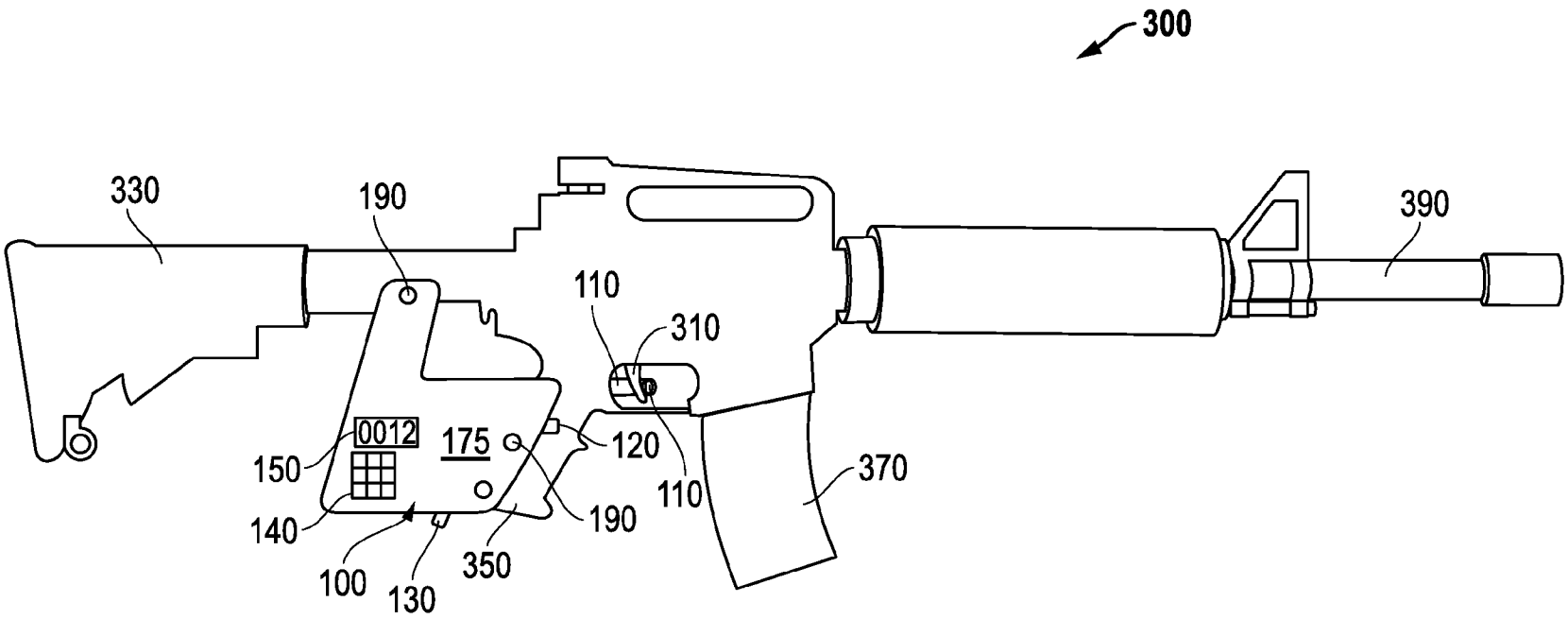
FIG. 3 is a side view of a firearm accommodating the trigger assist module as shown from the side depicted in FIG. 1.

Continuing with reference to FIG. 1, with added reference to FIG. 3, the module 100 is also equipped with securing implements 190 for sake of secure attachment to a firearm 300. In the embodiment shown, this may include the use of conventional nuts and bolts with appropriately sized and located slots at the firearm 300 and through the body 175 of the module 100. Of course, in other embodiments alternative types of securing implements 190 may be utilized. For example, hook and loop fasteners such as Velcro® may be utilized as well as clamps or other types of implements 190. Once more, as a practical matter, such securing implements 100, which do not result in any substantial altering of the firearm 300, may be of particular benefit. That is, in terms of user friendliness for the user and/or firearm manufacturers, such implements 300 do not require any substantial reconfiguring of the firearm 300 in order to accommodate the module 100.

In the embodiment of FIG. 1, the module 100 is also provided with a keypad 140 and display screen 150 to serve as an interface for the user. For example, as a matter of added safety, the keypad 140 may allow the user to type in a preset arming code, without which, the arming switch 130 and/or actuator 120 would remain non-functional, in other embodiments alternate types of identifying/access information may be utilized such as the use of a receiver for biometrics, voice activation or radio frequency of an electronically detectable key, More specifically, a users fingerprint, voiced key term, or RFID tag on a bracelet, may be utilized to confirm user identity and allow for arming and use of the module 100. Additionally, as detailed further below with added reference to FIG. 3, such modes of required identification for an authorized user of the module 100 may also be used to prevent use of the firearm 300, not just the module 100, in absence of such authentication. For example, the trigger 310 may be rendered immobile or inaccessible except through use of the module 100. In such circumstances, confirmation of the authorized user at the module 100 may be the only practical way to allow use of the firearm 300.

Continuing with reference to FIG. 1, additional information may be input through the watch face sized keypad 140 with confirmation at the display screen 150. This information may be related to the number of rounds stored in a magazine 370, programming information such as a number of reciprocations for the finger extension 110 or the rate of reciprocation and any other type of information related to use of the module 100 or firearm 300 (see FIG. 3). With added reference to FIGS. 2 and 5, this information may be stored at a processor 500 of a control unit 250 which, in the embodiment shown, is secured at the back side of the body 175 of the module 100.

Figure 2:
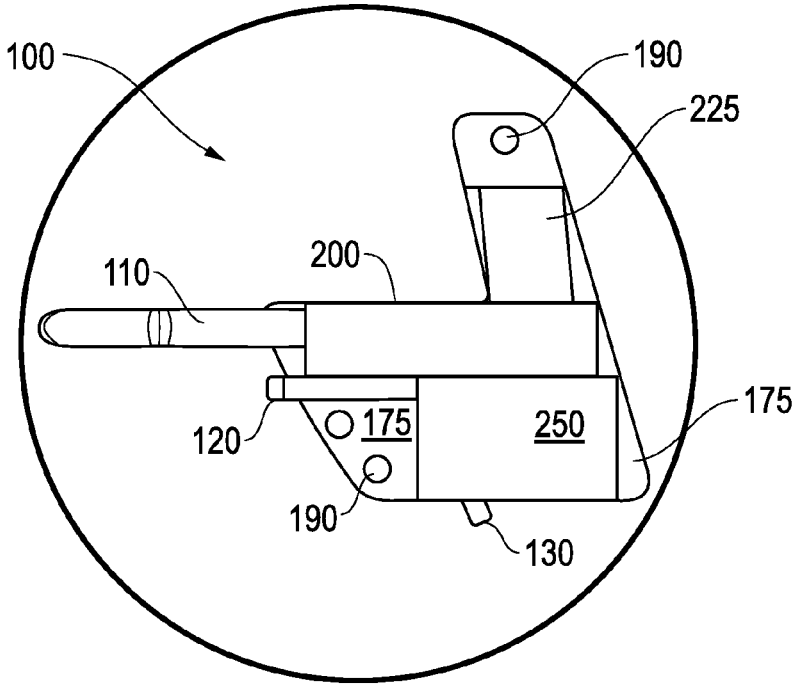
FIG. 2 is a view of an opposite side of the trigger assist module of FIG. 1 for use with a non-fully automatic firearm.
Figure 5:
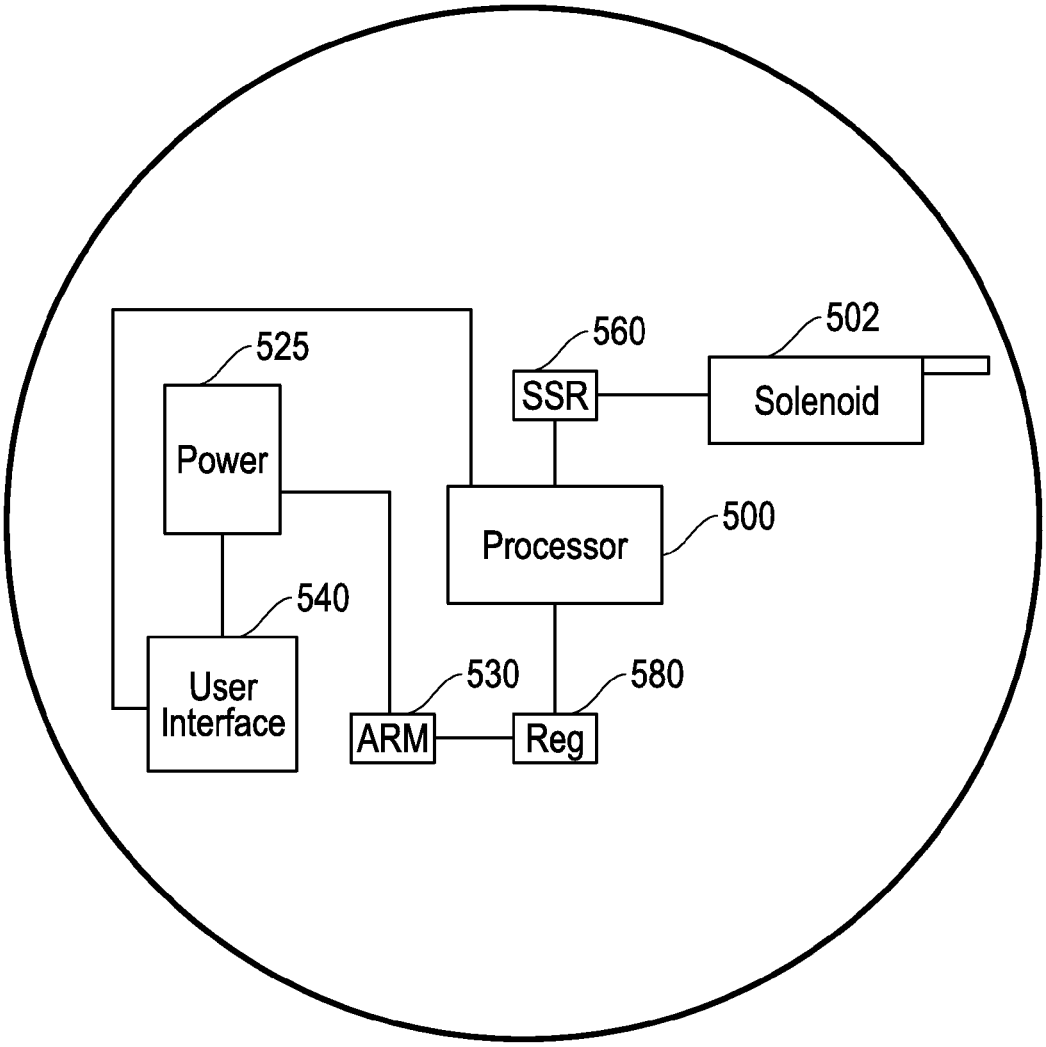
FIG. 5 is a schematic view of an embodiment of arranged electronic components for the trigger assist module of FIGS. 1 and 2.

Referring now to FIG. 2, a view of an opposite side of the trigger assist module 100 of FIG. 1 is shown. In this depiction it is apparent that in the body 175 is primarily in the form of a plate to which components such as the above noted control unit 250 are secured. Of course, in other embodiments, the body 175 may be more of an enclosed housing for accommodating the components. Regardless, as indicated above, the control unit 250 houses a processor 500 as shown in FIG. 5 which directs the reciprocation of the finger extension 110. Thus, with added reference to FIG. 3, not only may instructions be stored for directing the reciprocations, but tracking of the reciprocations may also be recorded. Specifically, real-time tracking of the number of rounds fired or remaining may be available to the user at ail times. For example, in one embodiment, the number of rounds remaining in a given magazine 370 may be displayed and dynamically updated at the display screen 150 during use of the firearm 300. Of course, this information may also be conveyed to the user through alternate interface modes. For example, the information may be conveyed audibly from a speaker of the module 100, or perhaps even with a wireless transmitter via Bluetooth speakers worn by the user.

Continuing with reference to FIG. 2, in addition to the control unit 250, a motor 200 is shown for driving the above described reciprocation of the finger extension 110. As used herein, the term "motor" is meant to refer to any suitable device for driving the actuation of the finger extension 110 as indicated. This may include a solenoid motor 200 as depicted in FIG. 2 and elsewhere. However, any number of other devices of appropriate size and functionality may be utilized. Specifically, the motor 200 is capable of actuating the finger extension 110 to pull a standard trigger 310 and fire a single round for each reciprocating pull of the extension 110.

Continuing with reference to FIGS. 1 and 2 the module 100 is also provided with a battery 225 for supplying power requirements of the solenoid motor 200, the control unit 250, the display 150 and any other power requiring components. The battery 225 may be a lithium battery of suitable size and voltage for powering such components. Once more, in order to save power, the arming switch 130 may need to be turned to an on position before any draw on the battery 225 is made available to components of the module 100. Indeed, in one embodiment, a light or audible sound may be present whenever the -module 100 is armed. Thus, the odds of accidentally leaving the module 100 armed and prone to accidental firing may be reduced along with any unnecessary drain on the battery 225.

Referring now to FIG. 3, a side view of a firearm 300 is shown which accommodates the trigger assist module 100 as shown from the side depicted in FIG. 1. The firearm 300 depicted is a standard M15. However, as indicated above, any non-fully automatic firearm may accommodate an appropriately sized and configured embodiment of a trigger assist module 100, the entirety of which being self-contained together as depicted and described herein. In the view of FIG. 3, the add-on modular nature of the trigger assist module 100 is readily apparent. From the butt 330 to the barrel 390 at the other end, the firearm 300 itself remains platform-free with no substantial modification required for the module 100 to be secured thereat. Indeed, in order for the finger extension 110 to stably engage the trigger 310 the handle 350 and firearm region forward of the butt 330 are configured to work with securing implements 190 as detailed above.

With this simple add-on or plug-in type of mating of the module 100 to the firearm 300, a user may turn on the module 100 at the arming switch and/or set firing parameters through the keypad 150 or other suitable interface. The firearm 300 is now ready for firing as assisted by the reciprocation of the finger extension 110 once the user presses the manual actuator 120. A countdown of remaining rounds may even be shown in real-time at the display screen 150 as described above.

Use of the module 100 to assist in pulling of the trigger 310 provides the user with several advantages, not the least of which is improved safety and control. In contrast to a conventional fully automatic firearm, the firearm 300 shown is of improved control with a single round fired for each poll of the trigger 310. This control and accuracy is enhanced by the addition of the depicted module 100. Similar to a scope that may be added on to a firearm, the module 100 also provides added accuracy and safety benefits. By way of specific example, the physiological tendency of the user to pull the firearm 300 to one side as the user pulls the trigger 310 is eliminated because the finger extension 110 performs the task of pulling the trigger 310. Indeed, in circumstances where the user is handicapped or otherwise compromised in terms of manual dexterity, the pulling of the trigger 310 by the extension 110 may make firing a round possible and/or a substantially safer undertaking.

In addition to control over the act of pulling a trigger 310, the module 100 also provides control over the rate or number of trigger pulls. This is in sharp contrast to a fully automatic firearm which does not allow the user adjustable or set control over the rate of trigger pulls. By the same token, the module 100 allows the user to focus concentration on holding sights on the target at hand during firing of the firearm 300 without undue concern over the potentially repeating task of pulling a trigger 310. Instead, uniform, precisely timed pulls of the trigger 310 are achieved by the module 100, freeing the user's focus to one of aiming (i.e. in contrast to a non-fully automatic firearm lacking an embodiment of the module 100).

Once more, the number of, or rate of, trigger pulls may be different from user to user in terms of attaining optimum accuracy. For example, one user may generally achieve maximum accuracy with a 3 second delay between rounds of up to 5 total rounds being fired. On the other hand another user may require a longer delay of say 5 seconds but be able to maintain maximum accuracy for up to about 10 rounds being fired. Regardless, the module 100 as described allows for such personalization so that each user may optimize his or her own personal accuracy. That is, one user may program the module 100 for a firing rate of every 3 seconds for a total of 5 shots whereas another may program a firing rate of every 5 seconds for a total of 10 shots to be fired. Along these lines, the trigger assist module 100 may be particularly beneficial for police and military use where training is provided in a manner that may allow each user to determine his or her own optimum firing parameters for sake of maximum accuracy when employing such bearable arms during handheld use.

Figure 4:
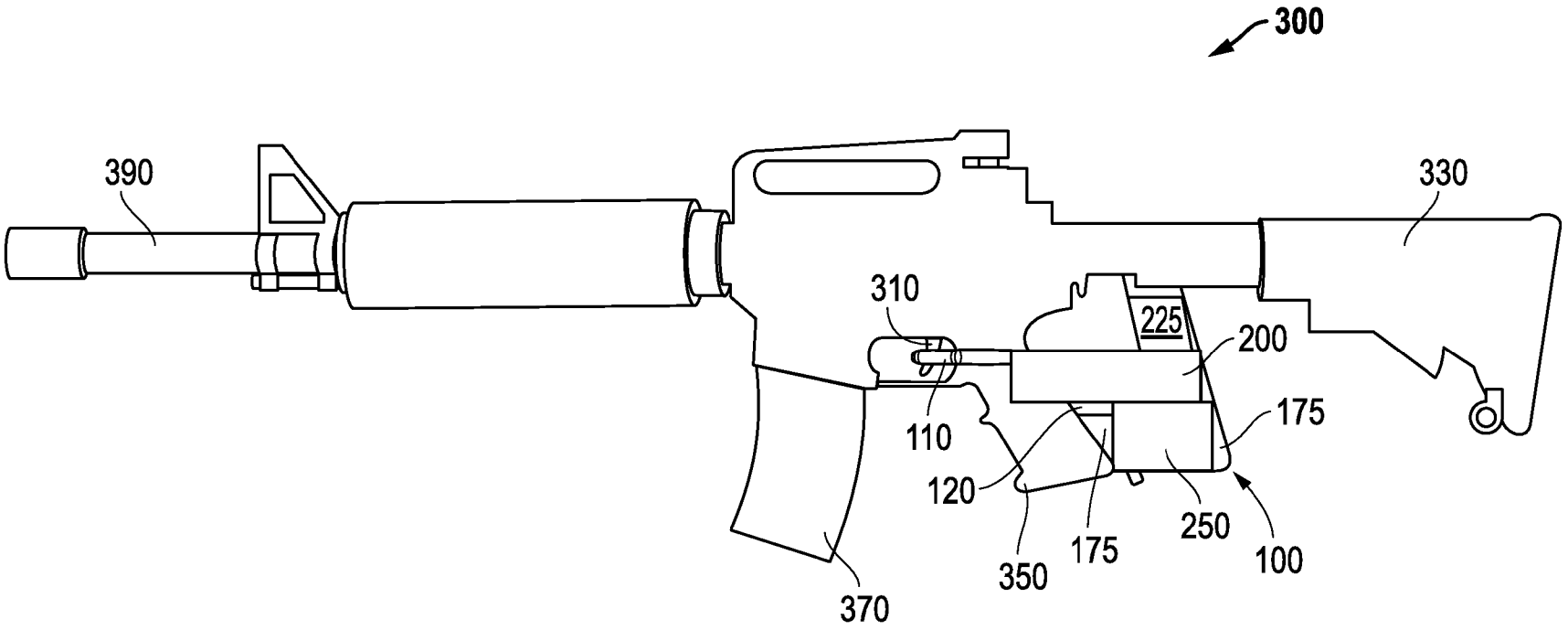
FIG. 4 is a side view of the firearm and module of FIG. 3 as shown from the opposite side as depicted in FIG. 2.

Referring now to FIG. 4, a side view of the firearm 300 and module 100 of FIG. 3 are shown from the opposite side as depicted in FIG. 2. In this view, the components of the module 100 are apparent in context with the firearm 300. So, for example, the finger extension 110 is fully visible as it traverses the trigger guard across the front of the trigger 310. Further, components such as the battery 225, motor 200 and control unit 250 are visibly secured to the plate-type body 175 of the module 100. In one embodiment, the battery 725 is a lithium battery of a 5-25 voltage rating which powers a solenoid version of the motor 200 for reciprocation of the finger extension 110, Further, the control unit 250 houses a processor 500 for controlling a rate of firing, the number of rounds to be fired and for storing other, potentially personalized information relative operation of the firearm 300.

In the embodiment of FIG. 4, the components discussed above are visible and manually accessible for replacement or repair. However, in another embodiment, the body 175 may serve as an enclosure, protecting the underlying components. In such an embodiment, the body 175 may also enclose the region of the trigger 310 and trigger guard such that this area is not manually accessible. Thus, where the trigger assist module 100 requires an arming code in order to operate, the module 100 naturally serves as a safety lock to any use of the firearm 300. That is, in such an embodiment the arming code as entered at the keypad 140 would be a prerequisite to use of the firearm 300 given that its operation would be dependent upon operation of the module 100 given the inaccessibility of the trigger 310 (see FIG. 3).

Of course, the same would be true of any arming lock for the module 100 (i.e. not limited to one in "code" form). Similarly, the trigger 310 could also be rendered inaccessible for manual user actuation in other manners apart from an enclosed body 175. For example, the finger extension 110 may interface both sides of the trigger 310 or otherwise engage the trigger 310 in an immobilizing fashion so as to prevent its movement in either direction except through reciprocation of the extension 110, Regardless, such an embodiment would provide an added degree of safety in terms of preventing children or other unauthorized users from being able to operate the firearm 300. Once more, unlike a conventional gun safe or trigger lock wedged behind the trigger 310, this form of safety locking does not pose a cumbersome hurdle to operation for the authorized user. Thus, the firearm 300 remains usable for the authorized user in relatively short order for any potential quick time circumstances.

Referring now to FIG. 5, a schematic view of an embodiment of arranged electronic components for the trigger assist module 100 of FIGS. 1 and 2 is shown. While these components may be arranged in a variety of ways, for sake of illustration, they are schematically shown similar to the layout of the module 100 as depleted in FIGS. 1 and 3. Specifically, the solenoid motor 502 is positioned at the upper right whereas the battery or power source 525 and user interface 540 are at the left (see the keypad 140 and display screen 150 of FIGS. 1 and 3).

Regardless, with added reference to FIGS. 2 and 4, these components are linked together and controlled by a control unit 250. Notably, the control unit 250 houses a processor 500 which stores and tracks a variety of different types of information pertinent to use of an associated firearm 300 as detailed hereinabove, furthermore, the control unit 250 also houses a solid state relay (SSR) 560 which serves as an interface between the processor 500 and the solenoid 502. Thus, actuation commands for the finger extension 110 from the processor 500 are precisely carried out by the SSR 560. As opposed to a mechanical relay, the electronic nature of the SSR 560 may render it less prone to wear over time and use.

In addition to the SSR 560, the processor 500 is also coupled to a regulator 580 and arming circuit 530. Thus, as indicated above and with added reference to FIG. 3, the module 100 may effectively be armed once the switch 130 is tripped. Further, a regulated signal indicative of a pressed manual actuator 120 may be relayed to the processor 500 for responsive action based on pre-stored information therein.

Figure 6:
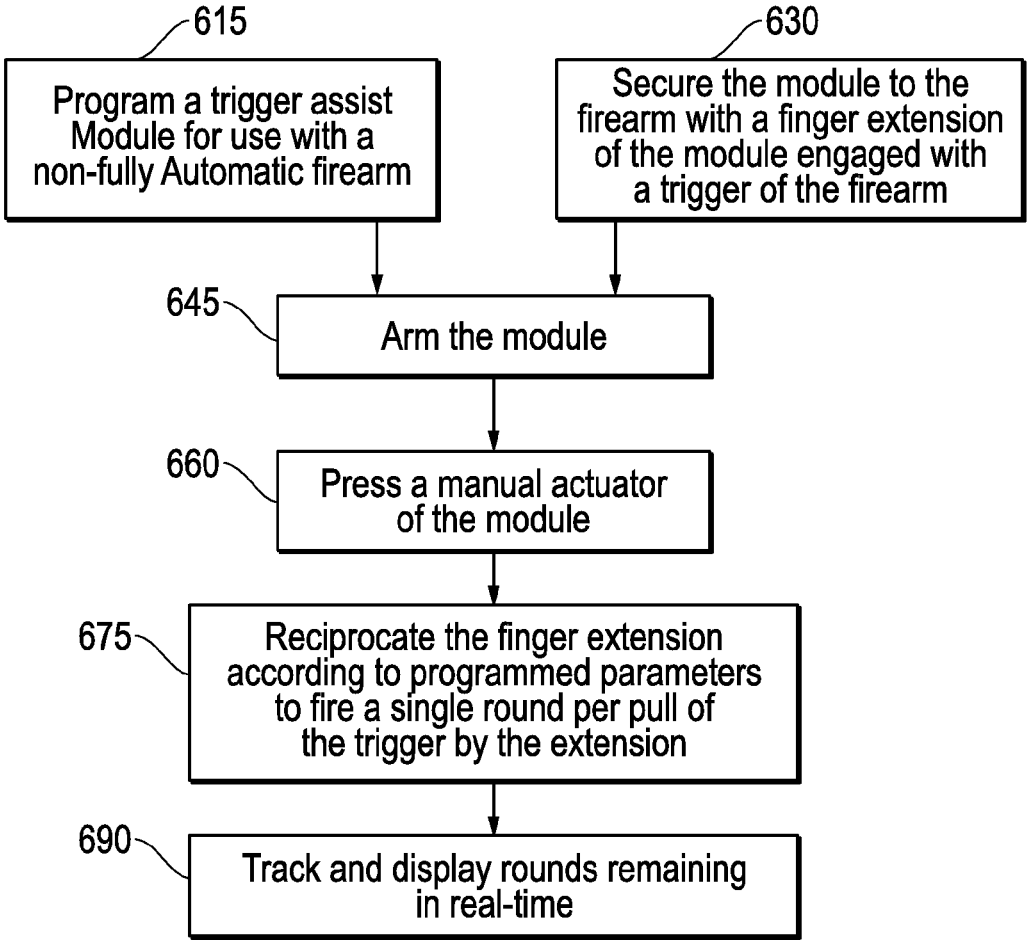
FIG. 6 is a flow-chart summarizing an embodiment of utilizing a trigger assist module to govern firing of a non-fully automatic firearm.

Referring now to FIG. 6, a flow-chart is shown summarizing an embodiment of utilizing a trigger assist module to govern firing of a non-fully automatic firearm. Specifically, as indicated at 615 and 630, the module may be programmed with firing parameters and secured to the firearm. This programming of the module may take place before or after securing of the module to the firearm. Further, these program parameters may be tailored to the user and/or the type of firearm and may include information such as a firing rate or number of rounds to be fired. Additionally, as indicated herein, the module may he secured to the firearm in a number of ways. So long as engagement between a finger extension of the module and a trigger of the firearm is stably assured, the module may be properly positioned for operation.

Once programmed and secured, the module may then be armed and ready for use as indicated at 645. Thus, pressing of the manual actuator as noted at 660 may lead to reciprocating of the module's finger extension as noted at 675. More specifically, the finger extension may reciprocate according to the programmed parameters to fire a single round per pull of the trigger. Once more, as indicated at 690, the module may be equipped with the capacity for real-time tracking and display or otherwise relay of information regarding rounds fired or remaining.

Embodiments described hereinabove include an add-on module-type of device for a firearm that is non-fully automatic. This trigger assist module serves as an interface tor a user in pulling a trigger of the non-fully automatic firearm. Thus, the opportunity for human error is reduced. For example, the physiological tendency of the user to move the firearm in conjunction with pulling of the trigger is eliminated. Indeed, for a person that is handicapped or otherwise compromised in terms of manual dexterity and ability, the ability to safely pull the trigger through use of the interfacing module may be of even more significant benefit. Once more, all of these benefits are achieved without the firearm being converted to a fully automatic firearm. Thus, the challenges of potential inaccuracy, reduced control and/or tracking the amount of ammunition spent during use may be substantially eliminated.

The preceding description has been presented with reference to presently preferred embodiments, Persons skilled in the art and technology to which these embodiments pertain will appreciate that alterations and changes in the described structures and methods of operation may be practiced without meaningfully departing from the principle, and scope of these embodiments. For example, given the electronic nature of the trigger assist module, one embodiment may be equipped with a pan, tilt and/or zoom camera and a receiver or other features supportive of remote non-manual actuation not requiring user pressing of the manual actuator (e.g. for police, military, sniper or other appropriate use). Furthermore, the foregoing description should not be read as pertaining only to the precise structures described and shown in the accompanying drawings, but rather should be read as consistent with and as support for the following claims, which are to have their fullest and fairest scope.

I claim:

1. A trigger assist module for a platform-free, non-fully automatic firearm with the module secured thereto, the entirety of the module and firearm being user-held for operation with the module comprising:

a finger extension for engagement with a trigger of the firearm;

a motor coupled to the extension for reciprocatingly driving the extension in an axial direction to pull the trigger for firing of the firearm;

a processor coupled to the motor for directing a controlled rate of the firing of the firearm upon manual aiming of the firearm during handheld use by a user;

a power source coupled to the motor and the processor to power the driving and the directing;

an arming switch incorporated into the module to allow manual arming of the module by the user during the handheld use; and an actuator to signal the reciprocating driving of the extension.

2. The module of claim 1 wherein the module accommodates a control unit comprising:

the processor;

a regulator coupled to the processor to serve as an interface to the actuator;

an arming circuit coupled to the processor to serve as an interface to the arming switch; and a solid state relay coupled to the processor to serve as a precise interface to the motor.

3. The module of claim 1 wherein the motor is a compact electrically powered solenoid.

4. The module of claim 1 wherein the power source is a lithium battery.

5. The module of claim 1 wherein the processor is configured to manage one of preset program information and dynamically updated real-time information.

6. The module of claim 5 wherein the preset program information is one of number and rate of trigger pulls and the dynamically updated real-time information is one of rounds spent and rounds remaining.

7. The module of claim 1 further comprising a user interface selected from a group consisting of a display screen, a keypad, at least one speaker, a wireless transmitter and a receiver.

8. The module of claim 7 wherein the receiver is one of a voice receiver, a radio frequency receiver and a biometric detection receiver.

9. The module of claim 1 further comprising at least one securing implement for securing the module to the firearm, the implement selected from a group consisting of a bolt-type implement, hook and loop fasteners and a clamp.

10. A non-fully automatic self-contained firearm with a trigger for pulling, the firearm to fire a single round per pulling of the trigger, the firearm incorporating a trigger assist module to aid in the pulling, the entirety of the self-contained firearm with module manually held during operation with the module comprising:

a finger extension for engagement with the trigger;

a motor coupled to the extension for moving the extension in an axial direction to achieve the pulling;

a processor coupled to the motor for directing the moving upon manual aiming of the firearm during handheld use thereof by a user;

a battery coupled to the motor and the processor to power the moving and the directing;

an arming switch incorporated into the module to allow direct manual arming by the user during the operation; and an actuator to initiate the motor to move the extension, the actuator activated by direct manual engagement therewith.

11. The non-fully automatic firearm of claim 10 wherein the firearm is a handheld semi-automatic firearm.

12. The non-fully automatic firearm of claim 10 wherein the trigger is inaccessible to manual user actuation.

13. The non-fully automatic firearm of claim 12 wherein the inaccessibility of the trigger for manual user actuation is provided by one of an enclosed body of the module and the finger extension being substantially immobilizing relative to the trigger.

14. A method of assisting a user in pulling of a trigger of a non-fully automatic platform-free, user held firearm, the method comprising:

programming a processor of a trigger assist module;

engaging a finger extension of the module with a trigger of the firearm with the module secured thereto;

arming the module by direct manual interaction therewith by the user; and manually pressing an actuator of the module by the user for reciprocating the extension to pull the trigger according to programmed parameters from the processor, the entirety of the firearm and module manually held by the user during the reciprocating.

15. The method of claim 14 wherein the programmed parameters are selected from a group consisting of total number of rounds to be fired and rate of firing of the rounds.

16. The method of claim 14 further comprising confirming the user as an authorized user at the module prior to the arming of the module.

17. The method of claim 14 further comprising:

recording the number of trigger pulls by the extension at the processor; and communicating one of the rounds left and the rounds fired to the user in real-time.

* * * * *